United States Patent [19]

Schäfer

[11] Patent Number: 4,804,039

[45] Date of Patent: Feb. 14, 1989

[54] PROCESS AND APPARATUS FOR ALTERNATELY HEATING AND COOLING A HEAT EXCHANGER

[76] Inventor: Otmar U. Schäfer, Pienzenauerstr. 7a, Munich 80, Fed. Rep. of Germany, 8000

[21] Appl. No.: 63,260

[22] Filed: Jun. 17, 1987

[30] Foreign Application Priority Data

Jun. 20, 1986 [DE] Fed. Rep. of Germany ..... 3620623

[51] Int. Cl.[4] ..... F28D 21/00

[52] U.S. Cl. ..... 165/2; 165/18; 165/31; 165/61

[58] Field of Search ..... 165/2, 61, 18, 31; 422/25, 26, 292, 295, 208

[56] References Cited

U.S. PATENT DOCUMENTS

| | | | |
|---|---|---|---|
| 2,082,460 | 6/1937 | Omsted | 422/295 |
| 4,057,391 | 11/1977 | Yamaguchi | 422/26 |
| 4,239,730 | 12/1980 | Fahlvik et al. | 422/295 |
| 4,373,574 | 2/1983 | Schafer | 165/61 |
| 4,592,412 | 6/1986 | Franz et al. | 165/61 |
| 4,685,507 | 8/1987 | Schafer | 165/61 |

FOREIGN PATENT DOCUMENTS

| | | |
|---|---|---|
| 1013062 | 1/1958 | Fed. Rep. of Germany . |
| 1188092 | 10/1965 | Fed. Rep. of Germany . |
| 2943797 | 5/1984 | Fed. Rep. of Germany . |
| 2723088 | 12/1986 | Fed. Rep. of Germany . |

*Primary Examiner*—Albert W. Davis, Jr.
*Assistant Examiner*—John K. Ford

[57] ABSTRACT

In a process and an apparatus for alternately heating and cooling a heat exchanger, the heating operation is effected by means of a steam-heated hot water-producing means and the cooling operation is effected by direct cooling by means of an open cooling circuit. Before switching over to the open cooling circuit, the heat exchanger is connected, to reduce the pressure, to the hot water-producing means whose steam feed conduit is shut off.

8 Claims, 7 Drawing Sheets

PROCESS AND APPARATUS FOR ALTERNATELY HEATING AND COOLING A HEAT EXCHANGER

DESCRIPTION

The present invention concerns a process and an apparatus for alternately heating and cooling a heat exchanger.

The heat exchanger, in the sense in which that term is used herein, may be part of a treatment apparatus or it may be the treatment apparatus itself. The heat exchanger is used for providing for alternately different temperature control in respect of the treatment apparatus or articles which are to be processed or handled by means of the treatment apparatus, using a heat exchange medium, generally water, which in that system does not come into contact with the treated articles. An example of such a treatment apparatus is a press.

A very wide range of different forms of process and apparatus for alternately heating and cooling heat exchangers is known. German published specification (DE-AS) No. 10 13 062 and German patent specification No. 1 188 092 describe for example hot water installations in which water is used as a heating medium and as a cooling medium. Also known are installations in which steam is used as the heating medium and water is used as the cooling medium and possibly as a pre-heating medium (see German patent specification No. 2 943 797). Those two basic types of installations for alternate heating and cooling each have advantages and disadvantages which, in order to enhance understanding of the invention described hereinafter, will be discussed with reference to FIGS. 1 and 2.

Figure 1:
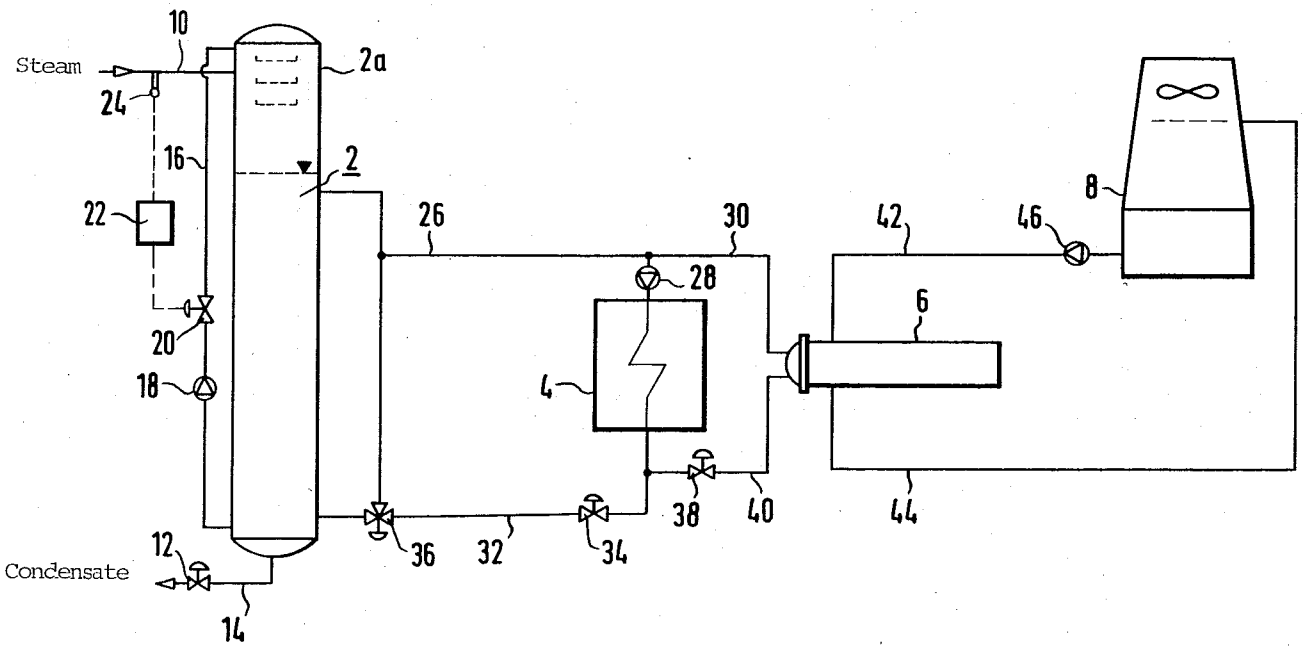
FIG. 1 PRIOR ART

FIG. 1 shows the basic structure of a hot water installation comprising a storage means 2 which at the same time serves as a hot water-producing means or generator in its uppor portion 2*a*, the heat exchanger 4 which is to be alternately heated and cooled, a cooler 6 and a cooling tower 8. The hot water-producing portion 2*a* of the storage means 2 is connected by way of a conduit 10 to a steam generator (not shown). A condensate discharge 14 which opens into the floor of the storage means 2 and which is provided with a shut-off valve 12 can be connected to the feed water portion of the steam generator (not shown). A conduit 16 which connects the lower end of the storage means 2 to the hot water-producing portion 2*a* thereof, a pump 18, a valve 20, a regulator 22 and a sensor 24 are parts of a load regulating system for the storage means 2. The water contained in the storage means 2 is passed by means of the pump 18 through the hot water-producing portion 2*a*, and is heated thereby. In that way, substantially the entire heat energy required for heating up the heat exchanger 4 can be stored in the storage means 2. The storage means therefore represents an energy buffer which prevents the substantial fluctuations in the level of consumption of heat energy by the heat exchanger 4 having an effect on the steam generator so that the steam generator is subjected to a quasi-continuous mean loading.

The upper portion of the storage means 2 is connected by way of a heating flow conduit 26 and a pump 28 to the feed side of the heat exchanger 4. One end of the primary circuit of the cooler 6 which also represents a heat exchanger communicates with the feed side of the heat exchanger 4 by way of a cooling flow conduit 30 and the pump 28. A heating return conduit 32 in which there are a shut-off valve 34 and a mixing valve 36 communicates the discharge side of the heat exchanger 4 with the lower end of the storage means 2. A cooling return conduit 40 which contains a shut-off valve 38 communicates the other end of the primary circuit of the cooler 6 with the discharge side of the heat exchanger 4. The secondary circuit of the cooler 6 communicates with the cooling tower 8 by way of conduits 42 and 44 and a pump 46. While the heating circuit by way of the conduits 26 and 32 and the primary circuit of the cooler 6, by way of the conduits 30 and 40, represent closed circuits, the secondary circuit of the cooler 6, by way of the conduits 42 and 44 and the cooling tower 8, is an open cooling circuit.

A relatively high pressure of for example 15 bars occurs in the conduit 10 and in the storage means 2. If pressure differences produced by the pumps are disregarded, then that pressure also obtains in the conduits 16, 26, 30, 32 and 40, the heat exchanger 4 and the primary circuit of the cooler 6. That presssure is kept substantially constant throughout the entire heating-cooling cycle, so that such an installation can be referred to as an equal-pressure hot water installation. A drop in pressure in the event of a substantial instantaneous removal of heat from the storage means 2 is prevented by the valve 20 in conjunction with the regulator 22 which, in the event of a pressure drop which is detected by means of the sensor 24, by way of the valve 20, throttles the charging circuit of the storage means 2. In that type of installation the uniform pressure is necessary in order to counteract the risk of vaporisation of the water, which arises in particular in the feed conduits to the heat exchanger 4. The mixing valve 36 serves for temperature regulation purposes by mixing return water from the conduit 32 with the feed water in the conduit 26. The associated controller is omitted for the sake of simplicity.

The equal-pressure hot water installation described hereinbefore with reference to FIG. 1 basically corresponds to the type of installation which is described in German patent specification No. 1 188 092, wherein the diagrammatic description set forth therein does not mention the mixing valve 36 which is necessary in a practical situation for temperature regulating purposes, and the elements which are also required, for controlling the charging circuit of the storage means. In addition, unlike the view shown in FIG. 1 hereof, German patent specification No. 1 188 092 also describes a further subdivision of the storage means, the lower portion thereof being in the form of an alternate storage means. In conjunction with two three-way valves, that system can provide that the hot water which is contained in the heat exchanger at the beginning of the cooling operation is returned into the storage means, without loading the cooling circuit, while the cool water contained in the heat exchanger at the beginning of the heating operation is passed into the alternate storage means, without loading the heating circuit.

Figure 2:
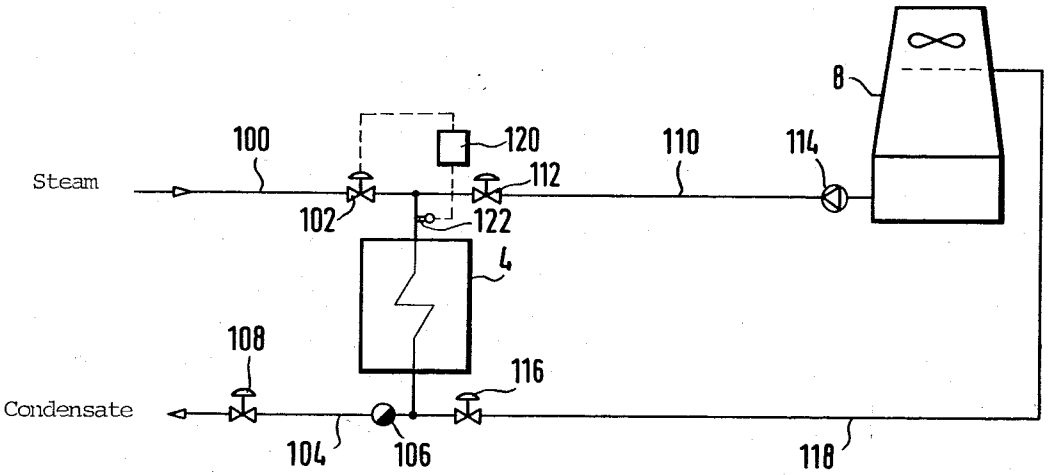
FIG. 2 PRIOR ART

The basic structure of a steam installation is shown in FIG. 2. The same reference numerals are used in FIGS. 1 and 2, to denote corresponding components. The steam installation includes the heat exchanger 4 and the cooling tower 8. The feed side of the heat exchanger 4 communicates with the steam generator which is also not shown herein, by way of a conduit 100 which includes a valve 102. The discharge side of the heat exchanger 4 is connected by way of a conduit 104 for example to the part of the steam generating circuit which is on the feed water side. The conduit 104 includes a condensate trap 106 and a valve 108. The feed side of the heat exchanger 4 is also directly connected to the cooling tower 8 by way of a conduit 110 which includes a valve 112 and a pump 114. The discharge side of the heat exchanger 4 is connected to the cooling tower by way of a conduit 118 which includes a valve 116. In that installation, during the heating phase, the valves 102 and 108 are open whereas the valves 112 and 116 are closed. In that a case the valve 102 is the control member of a temperature regulating circuit with the regulator 120 and the sensor 122. During the cooling phase the valves 102 and 108 are closed and the valves 112 and 116 are open. An installation of that design, without the components 120 and 122, is disclosed in German patent specification No. 2 943 797 and is described therein in conjunction with additional storage means for the recovery of heat, which will not be discussed in greater detail herein.

In comparison with the equal-pressure hot water installation shown in FIG. 1, the steam installataion of FIG. 2 is clearly simpler in design as it does not require either a hot water-producing means or an additional cooler and it involves less expensive fittings. Steam installations can therefore be produced at lower cost levels than equal-pressure hot water installations. A serious disadvantage of the steam installation is that the degree of accuracy of the temperature regulating action, in particular the uniformity of temperature distribution in the heat exchanger during the heating phase, leaves much to be desired. That is to be attributed to the fact that the heat transfer coefficient of steam is detrimentally affected by gases and contamination material in the heat exchanger, to a very much greater degree than the heat transfer coefficient of hot water. There is also the fact that such contamination material in hot water installations is flushed out of the heat exchanger 4 again by the hot water. An advantage of the steam heating system is the option of using an open cooling circuit, in other words, the heat exchanger can be connected to the cooling tower directly and without the interposition of a cooler, as shown in FIG. 2. However it is precisely that point that involves an increased risks of gases and other contaminating material being carried into the heat exchanger, with the above-mentioned consequence of irregular temperature distribution in the heat exchanger. Although there are heating/cooling installations in which, for reasons related to corrosion, connection of the heat exchanger to an open cooling circuit is avoided, there are also other situations of use in which the advantages of that direct cooling mode, in particular shorter cooling times and lower cost levels, play a decisive part. The steam installation combines those advantages with comparatively low levels of installation costs, but in return it suffers from the disadvantage of unsatisfactory temperature regulation and distribution. For the reasons already referred to above, the equal-pressure hot water installation makes if possible to achieve uniform distribution of a reference or desired temperature in the heat exchanger, as is often required, without difficulties. However to achieve that, the system involves considerably higher levels of installation costs, in comparison with the steam installation.

Having regard to the above-discussed advantages and disadvantages of the equal-pressure hot water installations on the one hand and the steam installations on the other hand, the object of the present invention is to provide a process and an apparatus for alternately heating and cooling a heat exchanger, which combine the advantage of low installation costs with the advantage of the high degree of accuracy in respect of temperature.

In accordance with the invention, that object is achieved by a process and an apparatus.

In contrast to the known equal-pressure hot water installation, the apparatus according to the invention may be referred to as a sliding or continuously-variable pressure hot water installation. Whereas the equal-pressure hot water installation provides that the pressure in the heating circuit and in the primary cooling circuit is constantly kept substantially constant, the invention makes uses of a varying pressure, which permits a hot water installation to be used in conjunction with direct cooling by an open cooling circuit. That provides for a saving of an additional cooler (corresponding to the cooler 6 in FIG. 1) while under some circumstances achieving the additional advantage of a shorter cooling time. The maximum pressure in the closed parts of the apparatus according to the invention may be limited to a value corresponding to the necessary heating temperature so that the hot water-producing means, the storage means and the heat exchanger can be designed for a lower maximum pressure and can thus be cheaper, in comparison with the equal-pressure hot water installation. The load regulating system required in the case of equalpressure hot water installations is not needed in the present invention.

Advantageous developments of the invention are characterised in the subsidiary claims.

The invention will be described in greater detail hereinafter by means of an embodiment with reference to the accompanying drawings in which:

FIG. 1 is a diagrammatic view of the basic structure of an equal-pressure hot water installation, FIG. 2 is a diagrammatic view of the basic structure of a steam installation, and FIGS. 3*a* through 3*e* show an embodiment of the invention, illustrating the individual steps in the process thereof.

In FIGS. 3*a* through 3*e*, the same reference numerals as those used in FIG. 1 and FIG. 2 respectively are employed to denote corresponding components.

A container 3 includes a hot water-producing means 3*a* in its upper portion and a storage means 3*b* in its lower portion. The hot water-producing means 3*a* is connected by way of a conduit 100 and a valve 102 to a steam generator (not shown). The valve 102 is used in a manner which will be described in greater detail hereinafter, to shut off the steam feed conduit 100 in normal operation of the system, and that is an important difference in comparison with the equal-pressure hot water installation shown in FIG. 1. In the embodiment illustrated in FIGS. 3*a* through 3*e*, the valve 102 is at the same time a control member of a temperature regulating circuit which also includes a pressure or temperature sensor 122 and a regulator 120. The pressure regulating system ensures that a predetermined reference or desired temperature is maintained in the heat exchanger 4 during the heating phase. That aim could in principle also be achieved with a mixing valve corresponding to the mixing valve 36 in FIG. 1, that is to say therefore by means of return mixing. In this alternative, the steam feed conduit 100 would require a valve corresponding to the valve 102 in FIGS. 3*a* through 3*e*, for shutting it off in normal operation of the system. In addition, a suitable throttle means would have to be provided to ensure that, when the conduit 100 is not in a shut-off condition, the hot water in the storage means 3b is at a temperature which is somewhat above the reference temperature of the heat exchanger 4, thus providing a regulating reserve for the mixing valve.

Communicating with the lower end of the container 3 is a condensate discharge 14 which is provided with a shut-off valve 12 and which can be connected to the part of the steam generator, which is on the feed water side. At a location corresponding to the lower part of the hot water-producing means 3a and the upper part of the storage means 3b, a flow conduit 26 connects the container 3 to the feed side of the heat exchanger 4, by way of a pump 28 and a shut-off valve 27. The discharge side of the heat exchanger 4 is connected to the upper part of the hot water-producing means 3a by way of a return conduit 29 with a shut-off valve 31, and also to the lower part of the storage means 3b by way of a return conduit 32 with a shut-off valve 34. The cooling tower 8 is connected by way of a cooling flow conduit 110 with a pump 114 and a check member 113, to the feed side of the heat exchanger 4. Instead of the check member 113, it would also be possible to use a shut-off valve similar to the valve 112 in FIG. 2. The cooling tower 8 is also connected to the discharge side of the heat exchanger 4 by way of a cooling return conduit 118 which includes a shut-off valve 116. .

FIGS. 3a through 3e show in that sequence the individual steps in the process, that is to say pre-heating, heating, pre-cooling, pressure reduction and cooling, which are repeated in a cyclic succession. Each of FIGS. 3a through 3e show in dark lines the conduits which carry a flow of water in the respective steps in the process. The numerical values which are set out hereinafter in respect of temperature and pressure relate to a case which is given only by way of example, of a heating-cooling cycle of the heat exchanger of 40° C.→160° C.→40° C.

Figure 3A:
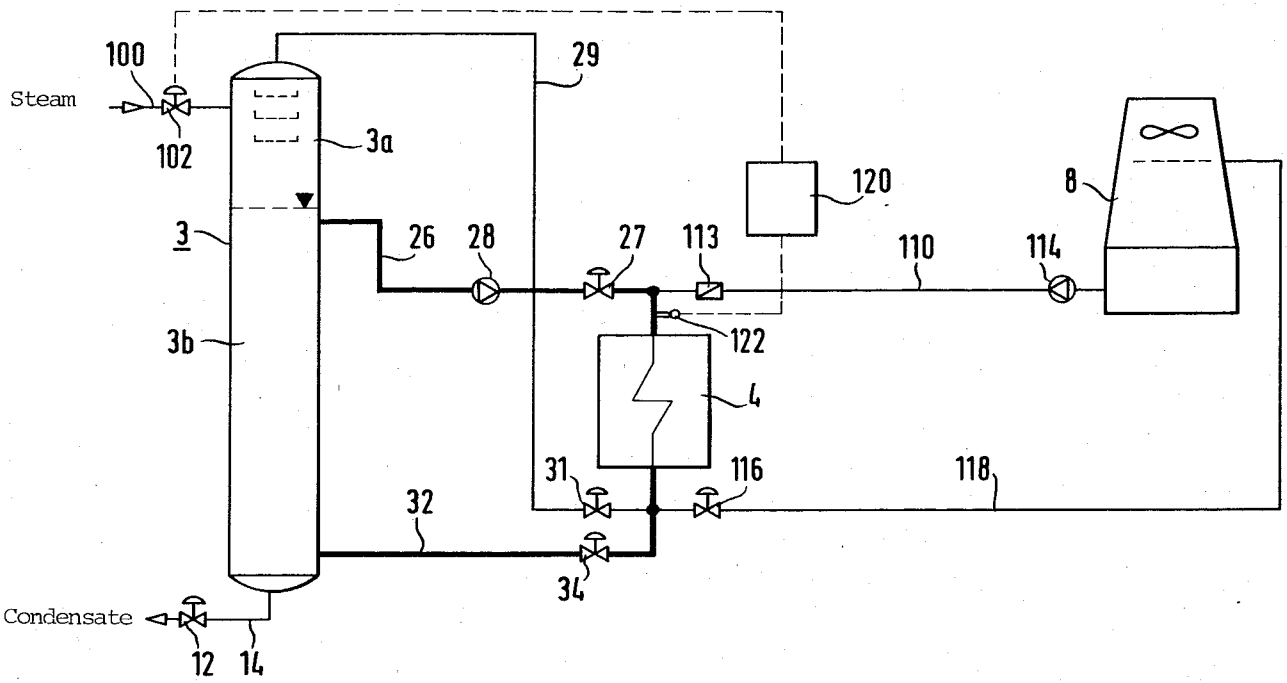

In the pre-heating step shown in FIG. 3a, the valves 27 and 34 are open whereas the valves 31, 102 and 116 are closed. From the pre-cooling step (FIG. 3c) of the preceding cycle, the storage means 3b contains hot water whose temperature can be about 110° C. at the beginning of the pre-heating step, in the illustrated example. Correspondingly, a pressure of about 1.5 bar obtains in the container 3 at that time. Let it now be assumed that, at the end of the pre-heating step shown in FIG. 3a, the water in the storage means has cooled down from the original temperature of 110° C. to about 75° C., while the heat exchanger 4 has been pre-heated from its initial temperature of 40° C. to about 85° C. With those numerical values which are given by way of example, with the valve 102 remaining in a closed condition, the pressure in the container 3 would drop to about 0.4 bar, that is to say, there would be a pressure below atmospheric therein. As that is undesirable, it is provided in a suitable manner that the pressure in the container 3 does not fall below 1 bar, for example by suitable control of the valve 102.

At the end of the pre-heating step a control device (not shown) closes the valve 34 and opens the valves 31 and 102, or sets the valve 102 of the control means off, by means of the regulator 120. The condition shown in FIG. 3b then occurs, in which the heat exchanger 4 is connected together to the hot water-producing means 3a by way of the conduits 26 and 29, to form a heating circuit. The regulator 120 which is supplied by the sensor 122 with the actual value in respect of the pressure or temperature in the heat exchanger 4 controls the valve 102 in the steam feed conduit 100 in such a way that the desired reference temperature of 160° C. is produced. That results in a rise in pressure from 1 bar to about 6 bars in the container 3.

Figure 3B:
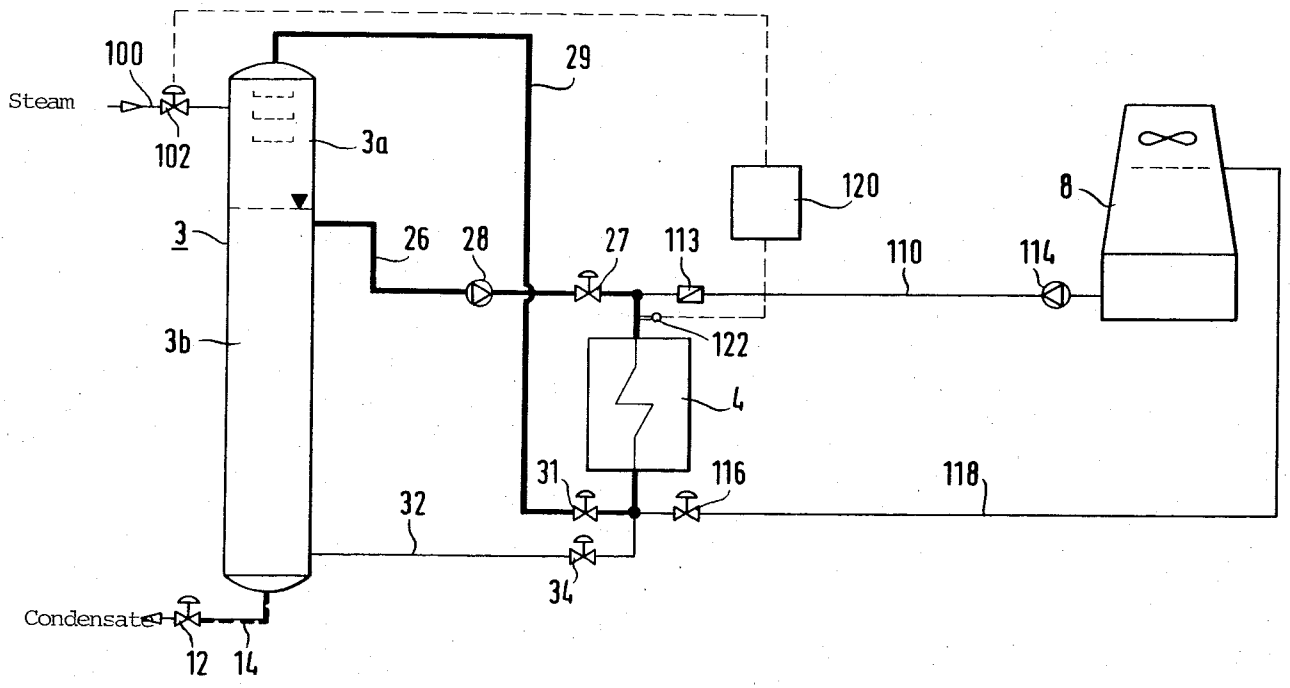
Figure 3C:
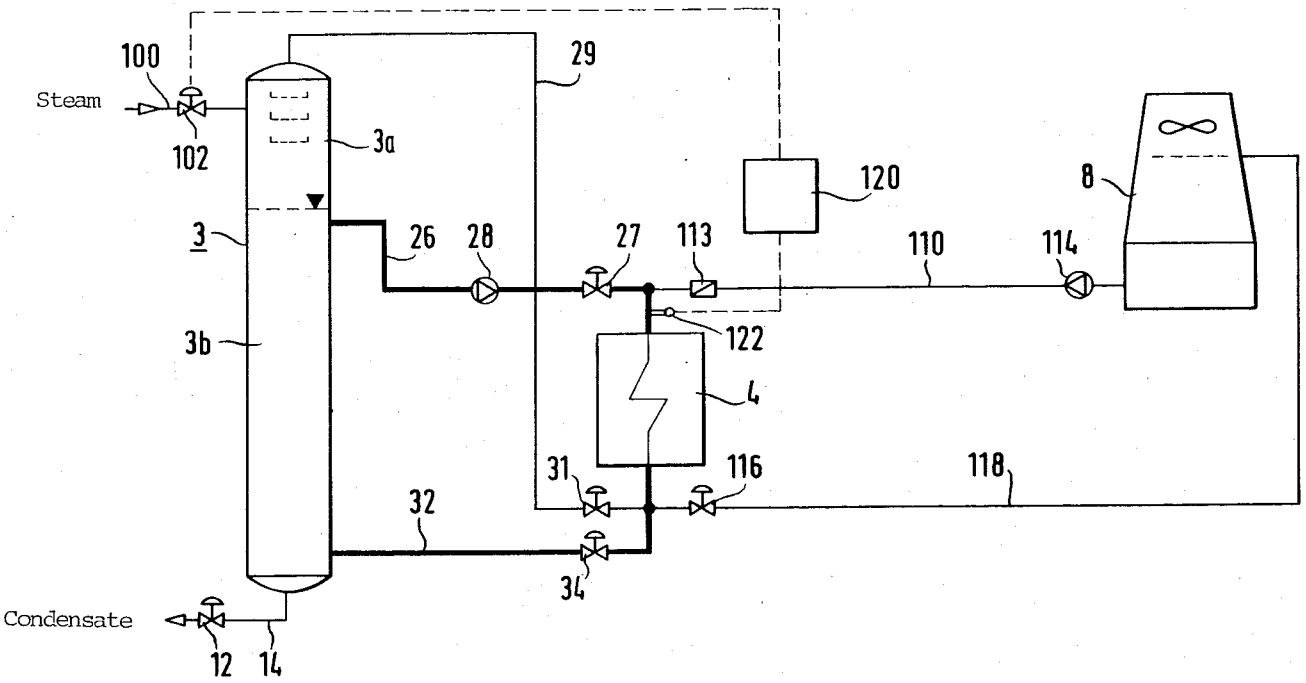

The heating step shown in FIG. 3b is then followed by the pre-cooling step shown in FIG. 3c. For that purpose, the control device which was mentioned above but which is not illustrated closes the valve 31, shuts off the supply of steam to the hot water-producing means 3a by closing the valve 102 and re-opens the valve 34 in the return conduit 32. As can be seen from FIG. 3c, the heat exchanger 4 is now again connected into a circuit with the storage means 3b, by way of the conduits 26 and 32. During that pre-cooling step the water in the storage means 3b is heated from a temperature of 75° C. to a temperature of 110° C. while the heat exchanger 4 is cooled down from 160° C. to 115° C. In that way a part of the heat energy contained in the heat exchanger 4 at the end of the heating step is recovered to be put to use again for renewed pre-heating in the next cycle. That recovery of heat contributes to reducing the loading peaks in regard to the steam generator. With the numerical example described herein, the pressure in the container 3 is still about 6 bars at the end of the precooling step shown in FIG. 3c. That pressure must be reduced before the heat exchanger 4 is connected into the open cooling circuit.

Figure 3D:
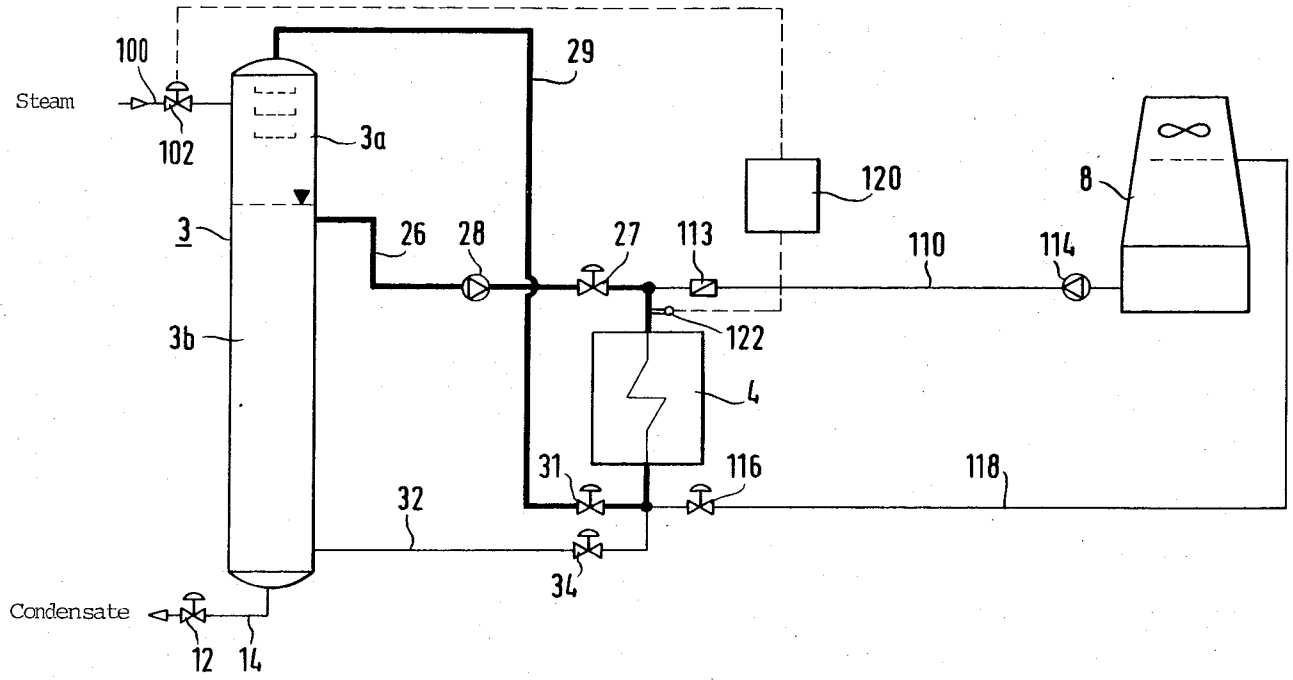

That purpose is achieved by the step shown in FIG. 3d, for pressure reduction. For performing that step in the process, the control device closes the valve 34 and opens the valve 31. The water which is contained in the heat exchanger 4 at that time and which has already cooled to a temperature of 110° C. to 115° C. is passed through the hot water-producing means 3a, with the steam feed conduit in a shut-off condition. When that occurs, the steam contained in the hot water-producing means 3e condenses, resulting in a pressure drop to about 1.5 bar.

Figure 3E:
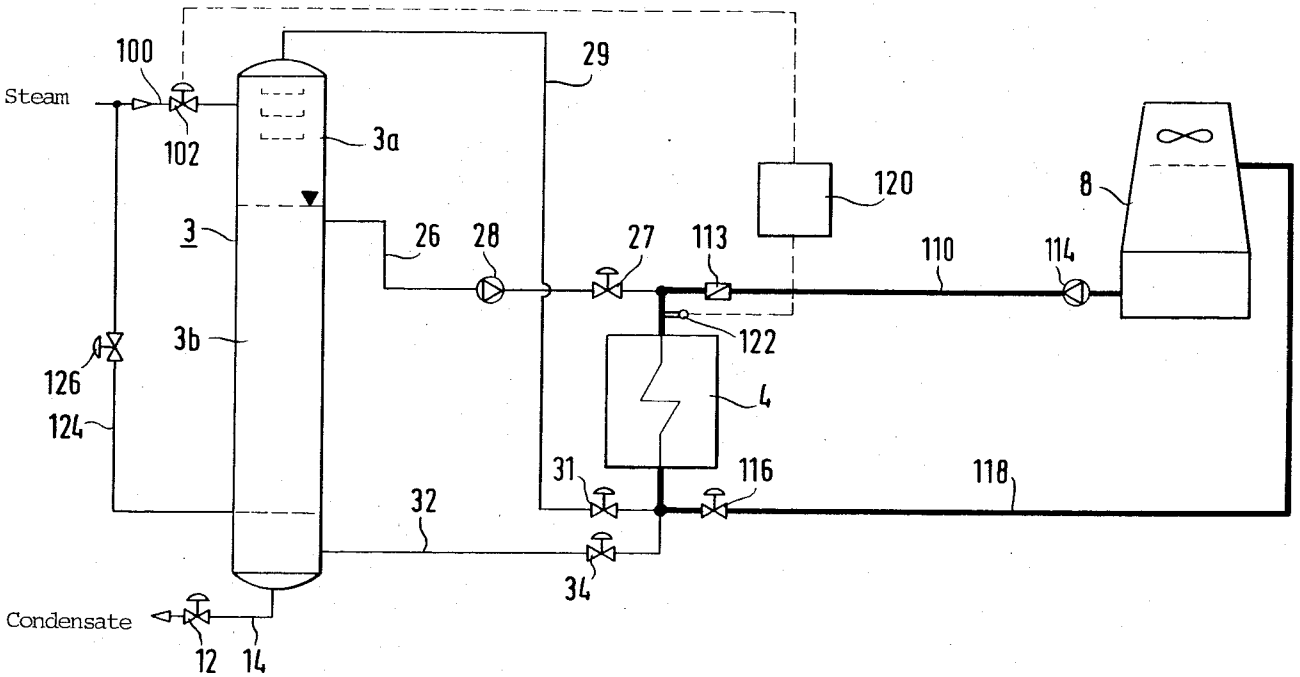

After the pressure drop, the system can be switched over without any danger to the cooling step shown in FIG. 3e. In that cooling step, the control device holds the valves 27, 31, 34 and 102 in a closed condition and the valve 116 in an open condition. It also switches off the pump 28 and switches on the pump 114. In the cooling step shown in FIG. 3e, the heat exchanger 4 is cooled to a temperature of 40° C., in the example described herein. That is then followed by a fresh cycle beginning with the pre-heating step shown in FIG. 3a.

The invention as described above with reference to an embodiment makes it possible to use a hot water installation which is operated with a sliding or varying pressure, for heating a heat exchanger which is to be alternately heated and cooled. In that way it is possible to combine the advantage which is inherent in a hot water installation, of good and uniform temperature regulation in the heat exchanger, with the possibility of using direct cooling by means of an open cooling circuit, with installation costs which are reducd in comparison with previous hot water installations. The recovery of heat by means of the storage means 3b reduces the loading peaks of a steam generator which is disposed upstream of the hot water-producing means, so that the steam generator can be operated with a better level of efficiency. In accordance with a development of the invention, that effect can be further reinforced by injecting steam during the cooling step into the storage means 3b which is completely separated from the heat exchanger by the closed valves 27, 31 and 34. That results in an increase in the temperature of the water contained in the storage means 3*b* so that in the next following pre-heating step (FIG. 3*a*), the heat exchanger 4 can already be heated to a higher temperature than for example 85° C. That option of also using the heat recovery storage means 3*b* as an energy buffer is indicated in FIG. 3*e* by the conduit 124 which connects the steam feed conduit 110 to a steam connection in the lower portion of the storage means 3*b*, by way of a shut-off valve 126. As stated, the shut-off valve 126 is opened by the control device during the cooling step.

In the above-described embodiment, the hot water-producing means 3*a* and the storage means 3*b* are disposed in a common container 3. Although that is not necessary, it is however advantageous in the case of a single-stage heat recovery system, for reasons of cost. However the described invention can also be used in conjunction with a multi-stage heat recovery mode, which is known per se from German patent specification No. 2 943 779. In that case, the hot water-producing means and the heat recovery storage means, of which more than one may then be provided, are in the form of separate units.

I claim:

1. A process for alternately heating and cooling a heat exchanger including the following steps:

(a) preheating the heat exchanger by connecting same to a storage means containing water at a temperature which is higher than the initial temperature of the heat exchanger, (b) heating the exchanger by connecting same to a steam-heated hot water-producing means, (c) pre-cooling the heat exchanger by re-connecting same to the storage means, and (d) cooling the heat exchanger by connecting same into a cooling circuit, characterised in that (e) after step (c) and before (d) the heat exchanger is connected to the hot water-producing means to reduce the pressure, (f) during steps (c) and (e) the steam feed conduit to the hot water-producing means is shut off and (g) the heat exchanger in step (d) is connected into a cooling circuit open to ambient pressure.

2. A process as set forth in claim 1 characterised in that during step (d) steam is injected into the storage means.

3. A process as set forth in claim 1 or claim 2 characterised in that during step (b) the supply of steam is controlled by a temperature regulator.

4. A process as set forth in claim 1 or claim 2 characterised in that during step (b) the supply of steam is controlled by a pressure regulator.

5. A process as set forth in claim 1 characterised in that in step (e) the pressure in the heat exchanger is reduced to not more than about 2 bars.

6. An apparatus for alternately heating and cooling a heat exchanger, comprising:

a steam-heated hot water-producing means for producing hot water, a storage means for storing water, a cooling means for cooling the heat exchanger, and control means for selectively connecting the heat exchanger into a heating circuit or into a cooling circuit, said control means comprising:

preheating means for preheating the heat exchanger by connecting same to said storage means containing water at a temperature which is higher than the initial temperature of the heat exchanger, heating means for heating the heat exchanger by connecting the same to said steam-heated hot water-producing means, precooling means for precooling the heat exchanger by re-connecting same to the storage means, pressure reducing means for connecting the heat exchanger to the hot water-producing means to reduce the pressure, cooling means for cooling the heat exchanger by connecting same into a cooling circuit open to ambient pressure, and shutting means for shutting off a steam feed conduit to the hot water-producing means while the heat exchanger is connected to the storage means by said precooling means and while the heat exchanger is connected to the hot water-producing means by said pressure reducing means.

7. Apparatus as set forth in claim 6, characterised by said shutting means including a valve which is used both for shutting off the steam feed conduit and as a control member of a temperature regulating circuit.

8. Apparatus as set forth in claim 6, characterised by further comprising steam injecting means for injecting steam into the storage means.

* * * * *